United States Patent [19]

Pitts

[11] 4,263,888

[45] Apr. 28, 1981

[54] HOME HEATING PLANT

[76] Inventor: Robert D. Pitts, 410 Skyline Dr., Harrison, Ark. 72601

[21] Appl. No.: 965,347

[22] Filed: Nov. 24, 1978

[51] Int. Cl.[3] ..... F24B 1/26; F24B 7/00

[52] U.S. Cl. ..... 126/123; 126/125; 126/137

[58] Field of Search ..... 126/121, 123, 125, 126, 126/137, 139

[56] References Cited

U.S. PATENT DOCUMENTS

| | | | |
|---|---|---|---|
| 1,044,708 | 11/1912 | Taylor | 126/137 |
| 2,258,882 | 10/1941 | Craig | 126/121 |
| 4,043,313 | 8/1977 | Sherman | 126/121 |
| 4,141,336 | 2/1979 | Fitch | 126/126 |
| 4,160,524 | 7/1979 | Stiber | 126/121 |
| 4,179,065 | 12/1979 | Zung | 126/121 |

FOREIGN PATENT DOCUMENTS 267420 3/1927 United Kingdom .

*Primary Examiner*—Herbert F. Ross

[57] ABSTRACT

A unitary, pre-fabricated heating plant combining the advantages of a fireplace facing one room, a cookstove facing another room, a central heating plant furnishing heat to other parts of the building and having integrated therewith provisions for drawing in outside air for combustion as well as fresh air, as required for air changes within the building.

1 Claim, 9 Drawing Figures

2
55
57
46
65
49
58
56
59
79
53E
54E
60
64
48
8
54
45
47
64
53
43
44
52
12
51
71
7
74
75
63
13
6
14
10
5
61
16
41
11
17
4
78
76
77
72
73
75
22
15
31E
31
26
35
33
32
24
28
27
19
18
25
23
21
42

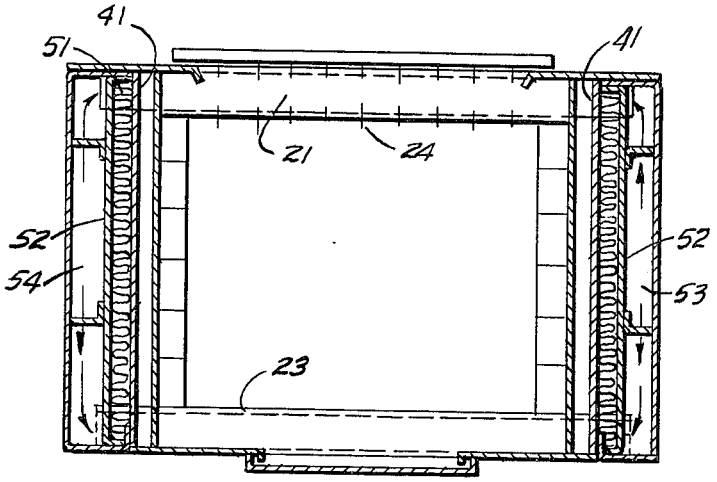
FIG. 5
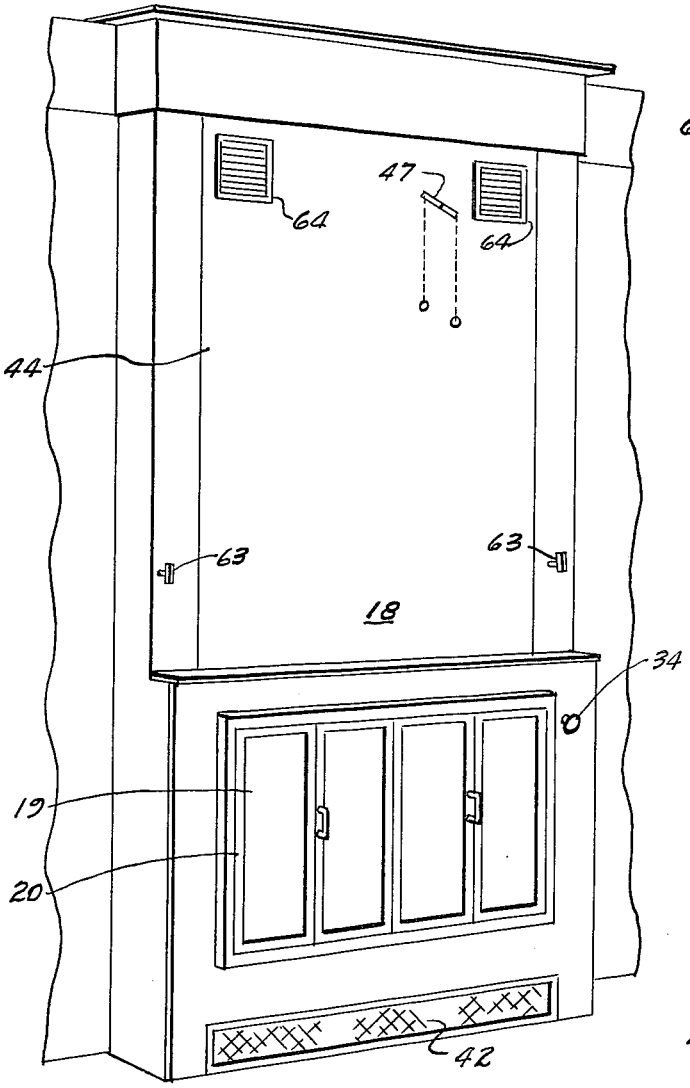
FIG. 3
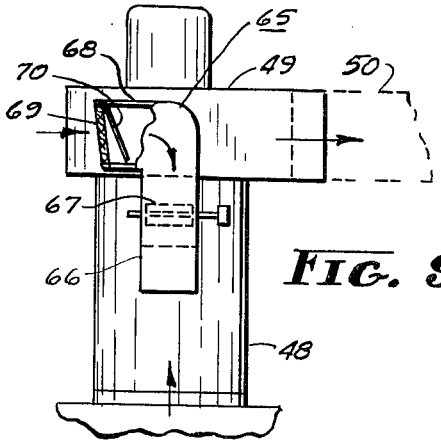
FIG. 9
FIG. 4
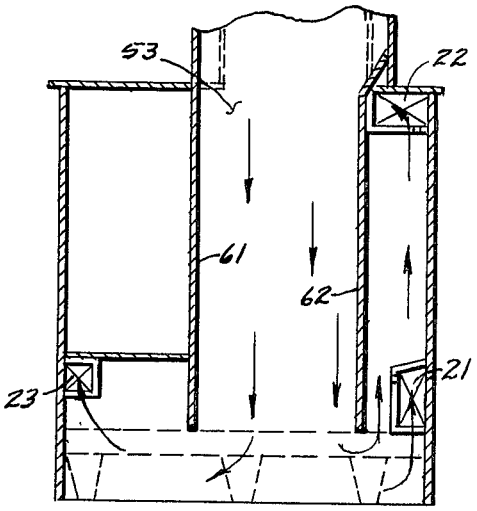

HOME HEATING PLANT

This invention relates primarily to heating plants of the wood-burning variety. It is a primary object of my invention to provide an improved device of that nature especially suited for use in one story homes built on a slab.

Another main object of my invention is the provision of such a device which is pre-fabricated and substantially self-contained so as to require a minimum of finishing operations to install.

Another main object of the invention is the provision of such a device having a fireplace adapted to face one room along with a relatively large area of heat radiating surfaces, the practical equivalent of a cookstove with oven adapted to face an adjoining room, also with a large area of heat-radiating surfaces, as well as means for mechanically circulating heat to other parts of the building.

Another major object of my invention is the integration into such a heating plant of means for taking air for combustion from unheated "attic" space above and, at the same time, using the air conduits to protect adjoining woodwork from the heat.

A still further object of my invention is the provision of means integrated into such a relatively compact, self-contained heating plant for drawing air in from the outside for the necessary replacement of stale air in the building.

Other and further objects and features of my invention will be more apparent from an examination of the following specification and drawings wherein I have shown and described a preferred embodiment of the invention.

In the drawings:

FIG. 3 is a perspective illustration of the fireplace side of the heating plant shown in FIGS. 1 and 2.

FIG. 4 is a partial view in vertical section taken along the line 4—4 of FIG. 1.

FIG. 5 is a view in horizontal cross-section taken along the line 5—5 of FIG. 1.

FIG. 9 is a fragmentary view of the fresh or replacement air inlet.

Figures 1, 2:
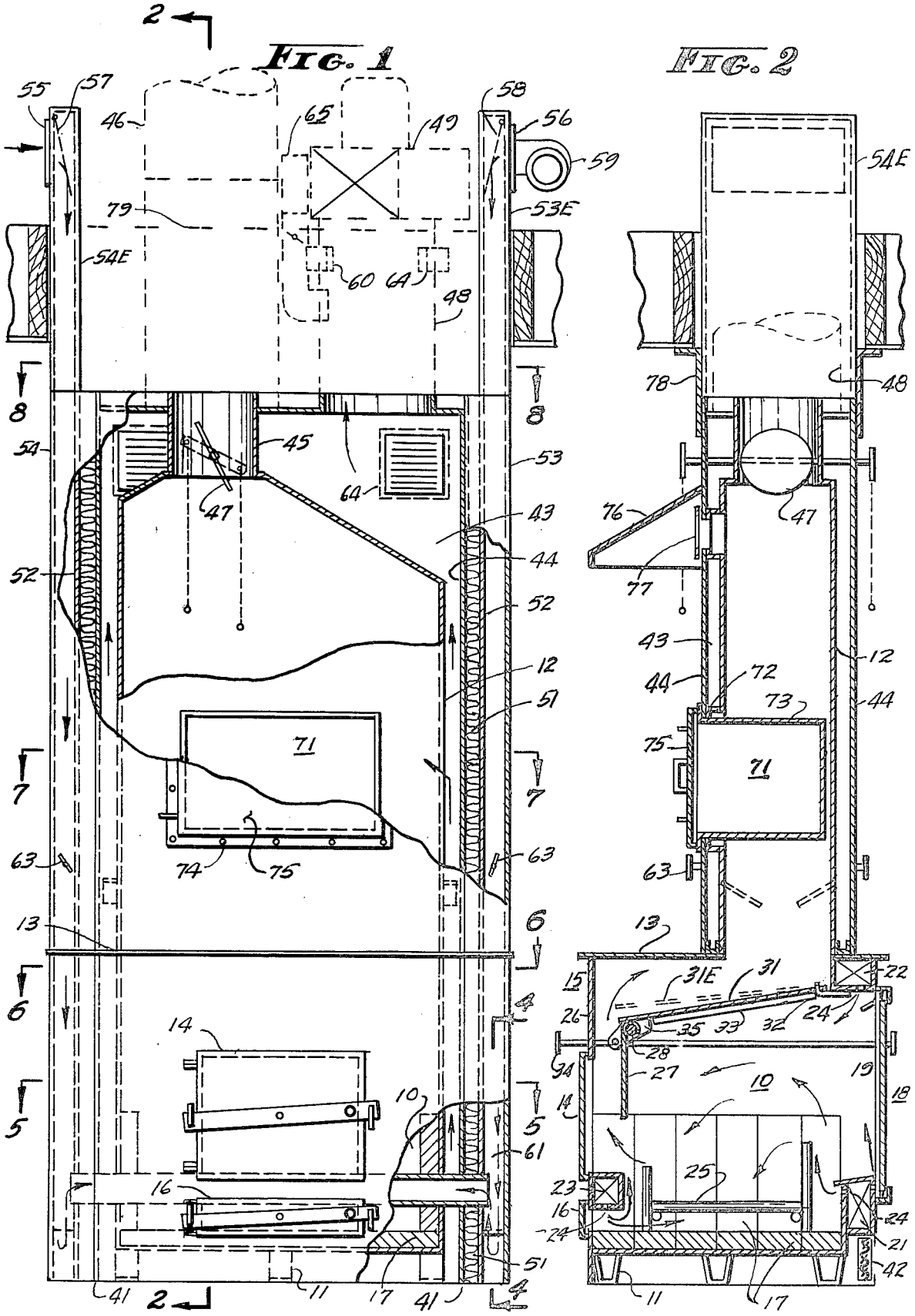
FIG. 1 is a view in front elevation of one side of a heating plant embodying my invention.
FIG. 2 is a view in vertical section taken along the line 2—2 of FIG. 1.

Referring now to these drawings and in particular to FIGS. 1, 2 and 3 thereof in which a firebox or combustion chamber 10 is supported off the floor by legs 11. A wide but relatively shallow heat exchanger 12 extends upwardly from the firebox 10 but is offset rearwardly from the front thereof to provide a utility section indicated generally at 15. This utility section includes a cooking surface 13, a feed door 14 and a clean-out door 16 for access to the primary combustion area or chamber 10 which is floored and lined with firebrick as indicated at 17.

The rear of the unit opposite the utility section 15 comprises a fireplace 18 including a large fireplace opening 19 adapted to be closed substantially air-tight by folding glass doors 20 in accordance with common practice.

Air for combustion is distributed within the firebox 10 by transverse ducts 21, 22 and 23 in each of which a row of orifices 24 is provided in the side or bottom walls thereof. Air supplied by ducts 21 and 22 sweeps the glass fireplace door before providing primary air for the combustion of wood supported in the fire basket 25. Duct 23 provides secondary air for mixing with unburned gasses passing upwardly between the front wall 26 of the firebox and the fire curtain 27 which is spaced inwardly from the front wall.

Figure 6:
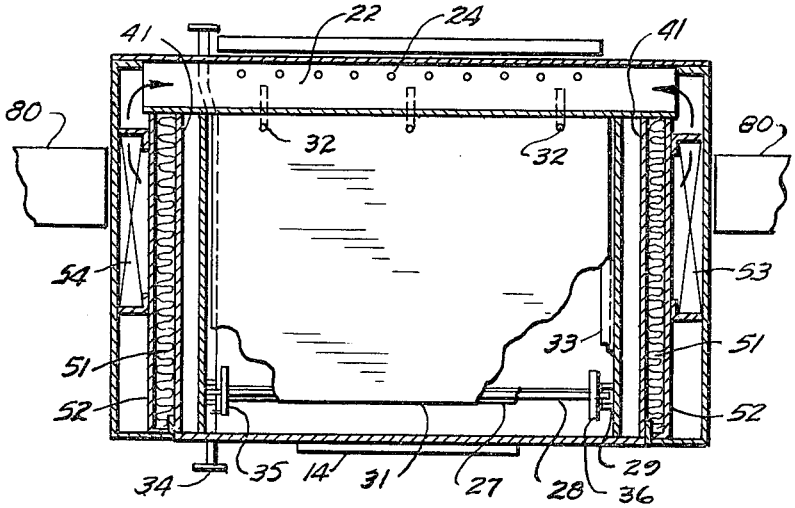
FIG. 6 is a similar view of horizontal cross-section taken along the line 6—6 of FIG. 1.
Figure 7:
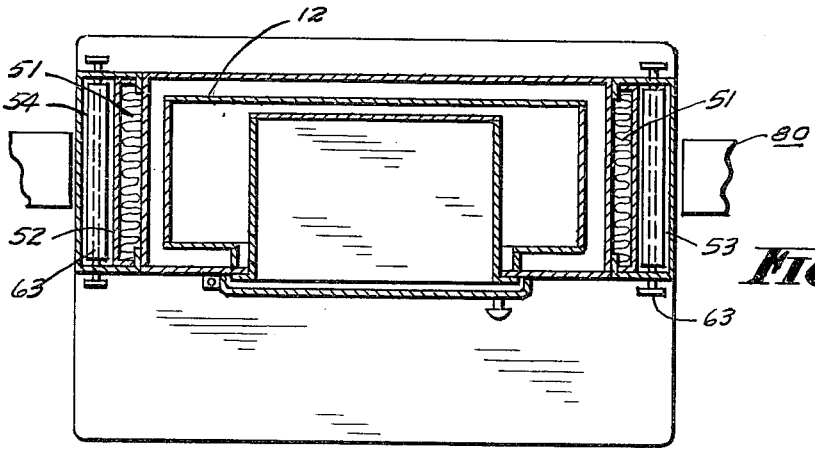
FIG. 7 is a view in horizontal cross-section taken along the line 7—7 of FIG. 1.
Figure 8:
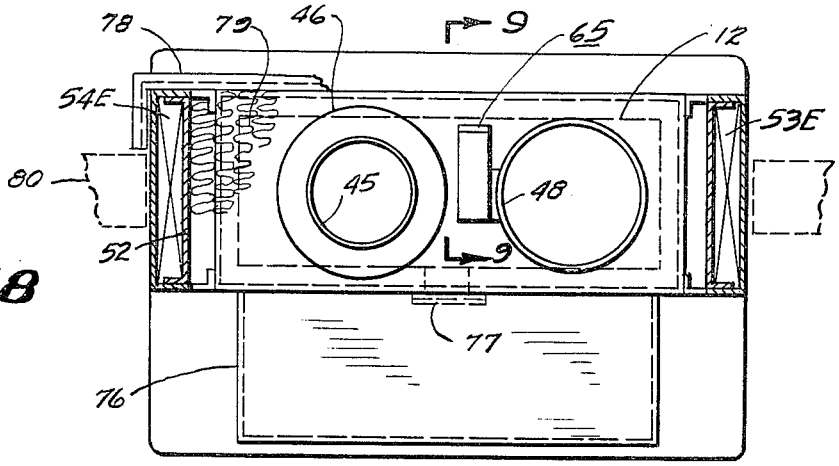
FIG. 8 is a view in horizontal cross-section taken along the line 8—8 of FIG. 1.

The fire curtain 27 is supported by a transverse rod 28 which is, in turn, supported by sockets 29 attached to the side walls 30 of the firebox. This is best shown in FIG. 6. A baffle 31 is pivotally supported at the rear of the firebox on L shaped hooks 32 and by the transverse curtain rod 28 at the front, as well as by rails 33 attached to the side walls 30. The forward edge of the baffle 31 may be elevated as indicated at 31E to permit the direct venting of gasses to the secondary combustion space above the baffle while starting a fire. This is accomplished by pushing in on push rod 34. This, in turn, moves a lever arm 35 attached to the transverse rod 28. This, in conjunction with a similar lever arm 36 at the opposite end of the transverse curtain rod 28, serves to wedge the baffle plate upwardly.

The firebox 10 is enclosed on both sides by casing ends 41 spaced to allow the circulation of air therebetween. Cool air which enters the space below the combustion chamber 10 through a floor-level filter 42, passes upwardly between the firebox end walls and the casing end walls 41 and the passes into the space 43 surrounding the heat exchanger 12 and enclosed by the upper casing 44.

The burned gasses passing upwardly through the heat exchanger 12 are exhausted through the vent 45 which is preferably offset to one side as shown. Sectional vent pipes 46, of triple-wall construction are used to carry the exhaust gasses through the attic space and roof to the outside of the building in accordance with common practice. A damper 47, in this vent, controls excess draft when it becomes necessary.

Warmed air, within the casing 44 surrounding the heat exchanger 12, passes upwardly through the warm air plenum 48 to a distribution blower 49 which forces the air through ductwork 50 to other areas of the building.

It should be noted that the entire heating plant, up to the point where it connects with the vent pipe and warm air plenum is of a height somewhat less than the more or less standardized ceiling height of eight feet. This makes it possible, during installation, to tilt the heating plant into vertical position and slide it into place beneath a rectangular opening in the ceiling.

The lower and upper casings 41 and 44 are both insulated on the sides only, with fireproof insulation such as rockwool 51 held in place by channel-like insulation retainers 52.

Tubular combustion-air ducts 53 and 54 extend vertically, alongside the insulation retainers 52 from the floor to the top of the main unit assembly with detachable extensions 53E and 54E adapted to extend into the attic space above. These extensions are provided with screened intake openings 55 and 56 along with weighted flapper valves 57 and 58 respectively.

One air intake 56 is equipped with a combustion-air blower 59 which may be controlled by a room thermostat (not shown) and a limit control 60, in accordance with common practice.

The warm air distribution blower 49 may be controlled by a fan switch 64, also in accordance with common practice.

The lower portions of the combustion-air ducts, where they are the full width of the end fire-box walls, are reduced in width to approximately the same width as the upper combustion-air ducts 53 and 54. This is done by means of interior partitions 61 and 62, as best shown in FIGS. 4 and 1. These partitions extend downwardly to a point below the level of the lowest of the air distribution ducts 21, 22 or 23 to provide a trap to thereby prevent hot air from those ducts from backing up into the combustion-air supply ducts.

The flow of air for combustion, through these ducts 53 and 54, is controlled manually by rotatable valves 63—63.

The combustion-air distribution ducts 21, 22 and 23 each extend outwardly through the walls of the combustion chamber, the casing, the insulation and into the lower combustion-air supply duct.

It can now be understood that partitions 80, built of combustable materials in contact with the side walls of such a heating plant, will be protected from the heat, not only by a layer of insulation, but by a layer of cooling air in the intake ducts.

A pair of manually operated warm air outlet grills 64—64 are located near the top of the casing on the fireplace side—for use particularly in the event of power failure to the blower 49.

A fresh-air intake 65 to provide for needed changes in room air is best shown in FIG. 9 and includes a duct 66 tapped into the side of the warm air plenum 48, a rotatable valve 67 to control the air flow, and an entry hood 68 having a screened inlet 69 and a weighted flapper valve 70.

A baking oven 71 may be set into the utility side of the unit. A gas-tight sleeve 72 is secured between the walls of the heat exchanger 12 and the casing 44. The box-like oven 73 slides into place and is secured by cap screws 74. The oven is closed by a door 75.

A vent hood 76 may be provided along with a rotary check draft 77 to draw off cooking odors with the help of the draft when the check draft is opened.

As stated before, a single rectangular opening is provided in the ceiling of the building to accommodate the vent pipe 46, the warm air plenum 48 and the combustion-air ducts 53E and 54E. A flanged, U shaped finishing strip 78 is mounted against the ceiling to enclose the space above the top of the casing. The entire space above the furnace casing and within the rectangular opening is preferably filled with loose, fireproof insulation 79.

Although I have shown and described a specific embodiment of my invention, it is apparent that modifications thereof may be made by those skilled in the art without departing from the spirit and scope of my invention as set forth in the following claims.

I claim as my invention:

1. A unitary, pre-fabricated heating plant and stove device adapted to be positioned between adjacent room spaces to be heated, said device having a firebox, a wide, shallow vertically positioned heat exchanger extending from the top thereof, a casing enclosing the heat exchanger, rectangular combustion-air ducts extending vertically alongside the casing and adapted to insulate the adjacent sides of said casing and to conduct combustion air from outside space above down to the firebox, the heat exchanger and firebox being of a height somewhat less than the ceiling height of the room space to be heated, a vent extending upwardly from the heat exchanger, and a warm air plenum extending upwardly from the casing, the said vent, the plenum and the combustion-air ducts, as a group, having a configuration such as to permit their passing through a single narrow rectangular opening into normally unheated space above said room spaces, said device having a fireplace opening in one wall of the firebox, a cooking surface and a feed door on the side of the firebox opposite the firebox opening, perforated, transversely extending, primary air ducts positioned above and below the fireplace opening and connected with the combustion air ducts, a generally horizontal baffle spaced below the cooking surface and extending from the fireplace side of the firebox to a point spaced from the feed door side, a fire curtain extending vertically downward from the said baffle, also at a point spaced from the feed door side, a secondary transverse air duct also connected with the combustion air ducts and adapted to feed secondary combustion air into the fire box at a point adjacent the lower edge of the fire curtain whereby a downdraft is created in the firebox and unburned combustible gasses are caused to sweep upwardly through a secondary combustion space generally defined by the firebox walls, the baffle, the fire curtain and the cooking surface.

* * * * *